US006120256A

United States Patent [19]

Miyazawa

[11] Patent Number: 6,120,256

[45] Date of Patent: Sep. 19, 2000

[54] VARIABLE DISPLACEMENT PUMP

[75] Inventor: Shigeyuki Miyazawa, Higashimatsuyama, Japan

[73] Assignee: Jidosha Kiki Co., Ltd., Japan

[21] Appl. No.: 09/292,543

[22] Filed: Apr. 15, 1999

[30] Foreign Application Priority Data

Apr. 23, 1998 [JP] Japan ..... 10-113865

[51] Int. Cl.[7] ..... F04B 49/00

[52] U.S. Cl. ..... 417/220; 417/559; 418/30

[58] Field of Search ..... 417/220, 559; 418/30

[56] References Cited

U.S. PATENT DOCUMENTS

| | | | |
|---|---|---|---|
| 5,226,802 | 7/1993 | Nakamura et al. | 417/299 |
| 5,518,380 | 5/1996 | Fujii et al. | 418/26 |
| 5,562,432 | 10/1996 | Semba et al. | 418/26 |
| 5,895,209 | 4/1999 | Miyazawa | 418/26 |
| 6,042,343 | 3/2000 | Semba et al. | 417/220 |

FOREIGN PATENT DOCUMENTS 56-143383 11/1981 Japan .

58-93978 6/1983 Japan .

*Primary Examiner*—Teresa Walberg
*Assistant Examiner*—Vinod D Patel
*Attorney, Agent, or Firm*—Townsend and Townsend and Crew LLP; Kenneth R. Allen

[57] ABSTRACT

A variable displacement pump has a swingable, displaceable cam ring fitted to form a pump chamber together with the outer circumferential surface of a rotor having vanes. Notches are formed by notching to have a substantially V-letter shape in the starting end portions, in the rotating direction of the rotor, of a pump suction opening and pump discharge opening that open to the pump chamber. The notch formed in the starting end portion, in the rotor rotating direction, of the pump suction opening is constituted by a plurality of notched grooves aligned in the radial direction of the pump chamber and having different lengths in the rotating direction of the rotor. Hence, the timing at which the pump suction opening communicates with a pressure chamber formed between the vanes changes in accordance with swing and displacement of the cam ring.

7 Claims, 12 Drawing Sheets

VARIABLE DISPLACEMENT PUMP

BACKGROUND OF THE INVENTION

The present invention relates to a variable displacement pump and, more particularly, to a variable displacement vane pump used in various types of pressure fluid utilizing equipments such as a power steering device for decreasing the force required to operate the steering wheel of a vehicle.

As a pump for a power steering device, generally, a displacement vane pump directly driven to rotate by a vehicle engine is used. In this displacement pump, the discharge flow rate increases or decreases in accordance with the rotation speed of the engine. A power steering device requires a steering auxiliary force which increases while the vehicle is stopped or is maneuvering at a low speed and decreases while the vehicle is maneuvering at a high speed. The characteristics of the displacement pump are contradictory to this steering auxiliary force. Accordingly, a displacement pump having a large volume must be used so that it can maintain a discharge flow rate necessary to produce a required steering auxiliary force even during low-speed driving with a low rotation speed. For high-speed driving with a high rotation speed, a flow control valve that controls the discharge flow rate to a predetermined value or less is indispensable. For these reasons, in the displacement pump, the number of constituent components increases, and the structure and path arrangement are complicated, inevitably leading to an increase in entire size and cost.

In order to solve these inconveniences of the displacement pump, various types of variable displacement vane pumps capable of decreasing the discharge flow rate per revolution (cc/rev) in proportion to an increase in rotation speed are proposed by, e.g., Japanese Patent Laid-Open Nos. 56-143383, 58-93978, and the like. According to these variable displacement pumps, a flow control valve is unnecessary unlike in a displacement pump. Waste of driving power is prevented to provide an excellent energy efficiency. No return flow to the tank occurs to reduce any oil temperature increase. In addition, a leakage in the pump and accordingly a decrease in volumetric efficiency can be prevented.

For example, in the variable displacement pump shown in Japanese Patent Laid-Open No. 56-143383, a cam ring is movably placed in a pump casing. A pair of fluid pressure chambers serving as control chambers are formed in the gap between the cam ring and the pump casing. Pressures before and after an orifice formed midway along the discharge path are guided to these fluid pressure chambers. The differential pressure between these pressures is made to directly act on the cam ring to move it against the biasing force of a spring. As a result, the volume of the pump chamber is changed to perform appropriate discharge flow rate control.

An example of such a variable displacement vane pump will be described briefly with reference to FIG. 12. Referring to FIG. 12, reference numeral 1 denotes a pump body; 1*a*, an adapter ring; and 2, a cam ring. The cam ring 2 is free to swing and be displaced in an elliptic space 1*b*, formed in the adapter ring 1*a* of the pump body 1, through a support shaft 2*a*. A press means applies a biasing force to the cam ring 2 in a direction indicated by an open arrow F in FIG. 12. A rotor 3 is accommodated in the cam ring 2 to be eccentric on one side to form a pump chamber 4 on the other side. When the rotor 3 is rotationally driven by an external drive source, vanes 3*a* held to be movable forward/backward in the radial direction are projected and retracted.

In FIG. 12, reference numeral 3*b* denotes a drive shaft of the rotor 3. The rotor 3 is driven by the drive shaft 3*b* to rotate in a direction indicated by an arrow in FIG. 12.

A pair of fluid pressure chambers 5 and 6 are formed on two sides around the cam ring 2 in the elliptic space 1*b* of the adapter ring 1*a* of the pump body 1, and serve as high- and low-pressure chambers, respectively. Paths 5*a* and 6*a* open to the chambers 5 and 6, respectively, to guide the control pressure for swingably displacing the cam ring 2, e.g., the fluid pressures before and after the variable orifice formed in the pump discharge path. When the fluid pressures before and after the variable orifice of the pump discharge path are introduced through the paths 5*a* and 6*a*, the cam ring 2 is swingably displaced in a required direction to change the volume in the pump chamber 4, thereby variably controlling the discharge flow rate in accordance with the flow rate on the pump discharge or outlet side. In other words, the discharge flow rate is controlled to decrease with increasing revolution count of the pump.

A pump suction opening 7 is formed to oppose a pump suction region 4A of the pump chamber 4. A pump discharge opening 8 is formed to oppose a pump discharge opening 4B of the pump chamber 4. These openings 7 and 8 are formed in corresponding ones of a pressure plate and a side plate (not shown) serving as stationary wall portions for holding a pump constituent element consisting of the rotor 3 and cam ring 2 by sandwiching it from two sides.

A biasing force is applied to the cam ring 2 from the fluid pressure chamber 6 as indicated by the arrow F in FIG. 12 to maintain the volume in the pump chamber 4 normally at the maximum value. A seal member 2*b* is placed in the outer peripheral portion of the cam ring 2 to define the fluid pressure chambers 5 and 6, together with the support shaft 2*a*, on the right and left sides.

Notches 7*a* and 8*a* are formed by notching into a substantially V-letter shape, to be continuous to the starting end portions of the pump suction opening 7 and pump discharge opening 8, respectively, in the rotating direction of the rotor 3. Along with rotation of the rotor 3, when the distal ends of the respective vanes 3*a* are brought into slidable contact with the inner circumferential surface of the cam ring 2 to operate the pump, the notches 7*a* and 8*a* having the substantially V-letter shape let the fluid pressure to gradually escape from the high-pressure side to the low-pressure side between a space sandwiched by the vanes close to the end portions of the openings 7 and 8 and a space sandwiched by the vanes adjacent to them. As a result, a surge pressure or resulting pulsation are prevented.

In the variable displacement pump having the above arrangement, a relief valve is formed in part of the pump discharge side to relieve its excessively large fluid pressure.

According to the conventional variable displacement vane pump described above, in a pump cartridge (pump acting portion) formed of the pump constituent element such as the rotor 3 and cam ring 2, pump chambers (chambers partitioned by the vanes 3*a*; pressure chambers) located at intermediate regions (portions denoted by reference numerals 9A and 9B in FIG. 12) corresponding to a region extending from the end point of the suction opening 7 in the pump chamber 4 to the start point (distal end portion of the notch 8*a*) of the discharge opening 8 and a region extending from the end point of the discharge opening 8 to the start point (distal end portion of the notch 7*a*) of the suction opening 7, respectively, change alternately between the pump discharge pressure and the pump suction or intake pressure.

This is due to the following reason. When a vane 3*a* leading in the rotating direction of the rotor 3 reaches the opening 8 or 7 (notch 8*a* or 7*a*) at the distal end side in the rotating direction, the corresponding pump chamber is set at the pump discharge- or suction-side port pressure of this opening 8 or 7 (notch 8*a* or 7*a*). When a following vane 3*a* is at the trailing end-side opening 7 or 8 in the rotating direction, the corresponding pump chamber is set at the port pressure of the following opening.

A thrust generated by the difference between the pressure chambers of the opposing intermediate regions 9A and 9B due to such pressure fluctuation or pressure non-equilibrium acts on the inner surface of the cam ring 2 to vibrate the cam ring 2. As a result, a fluctuation in flow rate or hydraulic pulsation phenomenon occurs on the pump discharge side to cause noise. This pulsation phenomenon appears as shown in, e.g., the graph of FIG. 7(B).

For these reasons, as the variable displacement pump described above, one having an odd number of vanes to relax any pressure fluctuation and pressure non-equilibrium and one in which a variable metering orifice is formed midway along the pump discharge path are proposed. In the latter one, a spool type control valve is switched by the fluid pressures before and after the orifice, and the fluid pressures before and after the orifice and the pump suction pressure are selectively supplied to the chambers 5 and 6 on the two sides of the outer circumferential portion of the cam ring 2, so that vibration of the cam ring 2 is suppressed. However, these countermeasures are insufficient, and a further countermeasure is sought for.

In particular, when the variable displacement pump is used as a hydraulic source for a power steering device that assists the force required to operate the steering wheel of a vehicle, the pump is rotationally driven in accordance with rotation of the engine. In this pump, the cam ring 2 swings by fluctuation in rotation speed of the engine, and its position with respect to the pump chamber 4 changes. When the cam ring 2 swings and is displaced in this manner, the positions of the pump suction opening 7 and pump discharge opening 8 as port grooves formed in the pump chamber 4 and the position of the cam ring 2 relative to each other change.

When swingable displacement of the cam ring 2 changes the position of the cam ring 2 relative to the port grooves described above in this manner, the timing at which the notches 7*a* and 8*a*, formed by notching in the starting end portions of the openings 7 and 8 in the rotor rotating direction to have a substantially V-letter shape, communicate with the pressure chambers (pump chambers) between the vanes 3*a* changes. This is due to the following reason. In the conventional pump, the notches 7*a* and 8*a* described above are formed to have fixed positions in the radial direction with respect to the pump chamber 4 and fixed lengths in the rotating direction. Hence, while the engine idles, the notches 7*a* and 8*b* communicate with the pressure chambers to allow smooth pressure fluctuation.

More specifically, with the notches 7*a* and 8*b* formed at the positions as described above, the pressure change occurring when the pressure chambers communicate with the corresponding openings 7 and 8 is relaxed, and the noise accompanying sharp pressure fluctuation can be decreased. If, however, this communication timing is set to match idling, when the rotation speed is high, the notches 7*a* and 8*b* do not function, and the noise increases.

SUMMARY OF THE INVENTION

It is, therefore, an object of the present invention to provide a variable displacement pump which can solve pulsation of the fluid pressure or noise, when a cam ring that expands or contracts the pump chambers in accordance with the revolution count of the pump or the load of the fluid utilizing equipment, swings regardless of the revolution count of the pump.

In order to achieve the above object, according to the present invention, there is provided a variable displacement pump comprising a rotor having vanes and rotatable in a pump body, a cam ring fitted on an outer circumferential portion of the rotor to form a pump chamber together with the rotor and arranged to be movable and displaceable in the pump body, first and second fluid pressure chambers formed on two sides of an outer circumferential portion of the cam ring between the cam ring and the pump body to guide therein a fluid pressure corresponding to a flow rate of a pressure fluid discharged from the pump chamber, thereby moving and displacing the cam ring, and a pump suction opening and a pump discharge opening formed in side plate members, that form the pump chamber together with the rotor and the cam ring, to oppose pump suction and discharge sides, respectively, of the pump chamber, wherein notches are formed by notching in a starting or terminal end portion, in a rotor rotating direction, of the pump suction opening and the pump discharge opening to have a substantially V-letter shape, and at least one of the notches is formed such that a timing at which either one of the pump suction opening and the pump discharge opening communicates with a pressure chamber formed between the vanes changes in accordance with swing and displacement of the cam ring.

BRIEF DESCRIPTION OF THE DRAWINGS

FIGS. 1A and 1B show a variable displacement pump according to the first embodiment of the present invention, in which FIG. 1A is an enlarged view of the main part for explaining the relationship between the notch of a pump suction opening and a cam ring during idling rotation, and FIG. 1B is an enlarged view of the main part for explaining the relationship between the notch of the pump suction opening and the cam ring during high-speed rotation;

FIGS. 2A and 2B are views for explaining the pump suction opening and the notch of FIGS. 1A and 1B, in which FIG. 2A is an end face view of the main part of a rear body having the pump suction opening formed with the notch, and FIG. 2B is a sectional view taken along the line II—II of FIG. 2A;

FIGS. 8A and 8B show a variable displacement pump according to the second embodiment of the present invention, in which FIG. 8A is an enlarged view of the main part for explaining the relationship between the notch of the pump suction opening and the cam ring during idling rotation, and FIG. 8B is an enlarged view of the main part for explaining the relationship between the notch of the pump suction opening and the cam ring during high-speed rotation;

FIGS. 9A and 9B are views for explaining the pump suction opening and the notch of FIGS. 8A and 8B, in which FIG. 9A is an end face view of the main part of a rear body having the pump suction opening formed with the notch, and FIG. 9B is a sectional view taken along the line IX—IX of FIG. 9A;

FIGS. 10A and 10B show a variable displacement pump according to the third embodiment of the present invention, in which FIG. 10A is an enlarged view of the main part for explaining the relationship between the notch of the pump discharge opening and the cam ring during idling rotation, and FIG. 10B is an enlarged view of the main part for explaining the relationship between the notch of the pump discharge opening and the cam ring during high-speed rotation;

FIGS. 11A and 11B show a variable displacement pump according to the fourth embodiment of the present invention, in which FIG. 11A is an enlarged view of the main part for explaining the relationship between the notch of the pump discharge opening and the cam ring during idling rotation, and FIG. 11B is an enlarged view of the main part for explaining the relationship between the notch of the pump discharge opening and the cam ring during high-speed rotation.

DESCRIPTION OF THE PREFERRED EMBODIMENTS

FIGS. 1A and 1B, and FIGS. 2 to 5 show a variable displacement pump according to the first embodiment of the present invention. In the first embodiment, a vane type oil pump serving as a hydraulic pressure source for a power steering device will be described with referring to FIGS. 1A and 1B and FIGS. 2 to 5.

Figure 3:
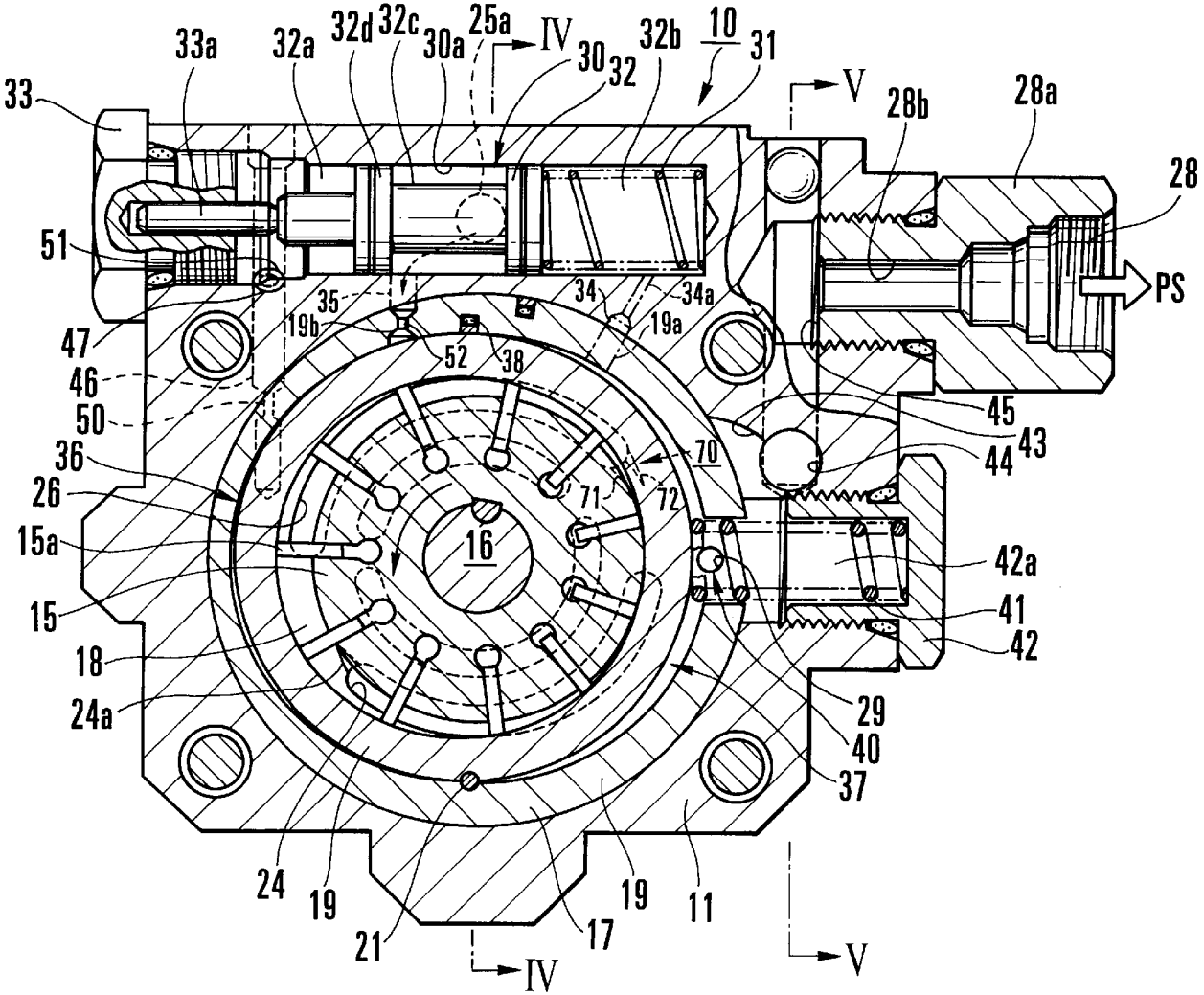
FIG. 3 is a schematic cross-sectional view showing the structure of the main part of a variable displacement pump to which the present invention is applied.
Figure 4:
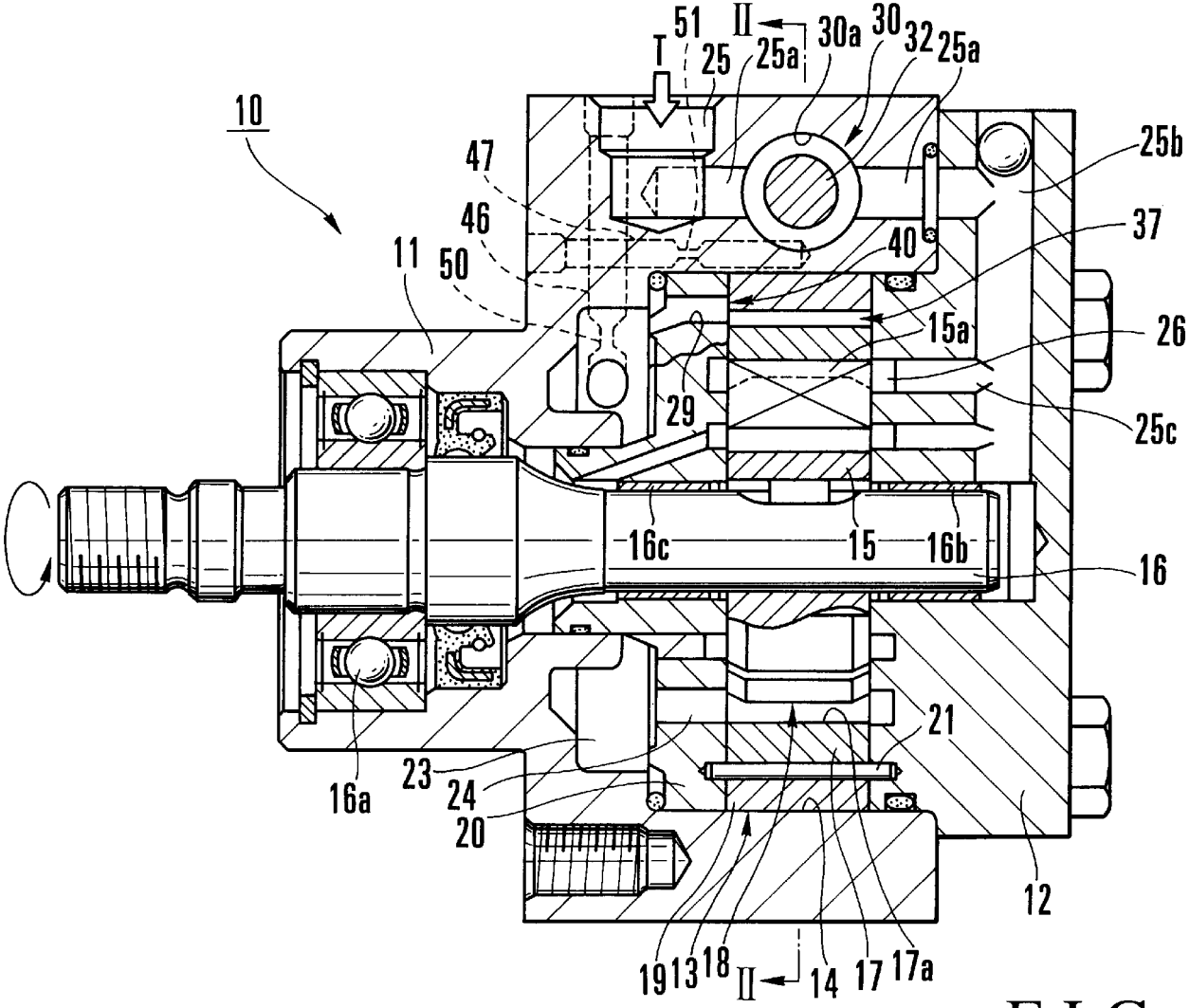
FIG. 4 is a sectional view taken along the line IV—IV of FIG. 3.

A vane type variable displacement pump denoted by reference numeral 10 has a front body 11 and a rear body 12 constituting a pump body, as shown in FIGS. 3 and 4. The entire portion of the front body 11 forms a substantially cup-like shape, as shown in FIG. 4. A housing space 14 for housing a pump constituent element 13 as a pump cartridge is formed in the front body 11. The rear body 12 is integrally combined with the front body 11 to close the opening end of the housing space 14. A drive shaft 16 for externally, rotationally driving a rotor 15 serving as the rotation element for the pump constituent element 13 extends through the front body 11, and is rotatably supported by the front body 11 through bearings 16*a*, 16*b*, and 16*c* (the bearing 16*b* is disposed on the rear body 12 while the bearing 16*c* is disposed on a pressure plate 20 (to be described later)).

A cam ring 17 has an inner cam surface 17*a* fitted on the outer circumferential surface of the rotor 15 having vanes 15*a*, to form a pump chamber 18 between the inner cam surface 17*a* and rotor 15. The cam ring 17 is movably arranged in an adapter ring 19 that fits the inner wall portion of the housing space 14, in order to change the volume of the pump chamber 18, as will be described later.

The adapter ring 19 serves to hold the cam ring 17 in the housing space 14 of the front body 11 to be movable.

The pressure plate 20 is stacked on the front body 11 of the pump cartridge (pump constituent element 13), constituted by the rotor 15, cam ring 17, and adapter ring 19 described above, to press against it. The end face of the rear body 12 is pressed against the opposite side surface of the pump cartridge as a side plate. When the front body 11 and rear body 12 are integrally assembled, the pump cartridge is assembled in a required state. These members construct the pump constituent element 13.

The pressure plate 20 and the rear body 12 stacked on it through the cam ring 17 to serve as a side plate are integrally assembled and fixed to each other while they are positioned in the rotating direction by a seal pin 21 (to be described later), which serves also as a positioning pin and an axial support portion for swingably displacing the cam ring 17, and by an appropriate rotation preventive means (not shown).

A pump discharge pressure chamber 23 is formed in the housing space 14 of the front body 11 on the bottom portion side. The pump discharge pressure chamber 23 exerts the pump discharge pressure on the pressure plate 20. A pump discharge opening 24 is formed in the pressure plate 20 to guide the pressure oil from the pump chamber 18 to the pump discharge pressure chamber 23.

A suction port 25 is formed in part of the front body 11, as shown in FIG. 4. A suction fluid entering through the port 25 flows through a pump suction path 25*a* formed in the front body 11 to extend through a valve hole 30*a* of a control valve 30 (to be described later), and paths 25*b* and 25*c* formed continuously in the rear body 12, and is supplied into the pump chamber 18 through a pump suction opening 26 formed in the end face of the rear body 12.

In this embodiment, in order to guide the suction fluid from the suction port 25 to the pump chamber 18, the pump suction path 25*a* extending across the control valve 30, i.e., through the valve hole 30*a* of the control valve 30, is used. This is due to the following reason. In the pump used for steering force control as in this embodiment, the flow rate to be supplied is as small as 7 l/min. Even if the suction fluid drawn into the suction port 25 by suction from a tank T flows through the control valve 30, no problem occurs in practice.

When this arrangement is employed, as compared to the conventional structure in which the suction port 25 is formed between the control valve 30 of the front body 11 and the path 25*b* of the rear body 12, the axial length of the pump 10 can be decreased, so that the pump 10 can be down-sized. This is because the rear body 12 can particularly be made compact due to the path arrangement, and the pump 10 can be mounted on the tank T from the front body 11 side, allowing a stable mounting state.

A pump discharge fluid supplied from the pump chamber 18 through the pump discharge path 24, the pump discharge pressure chamber 23, a fluid path hole 29 formed at a different position in the pressure plate 20, a second fluid pressure chamber 37 (to be described later), a spring chamber 42*a* formed of a plug 42 for storing a spring 41 that biases the cam ring 17, a notched groove 43 formed in the front body 11, and path holes 44, 45, and 28*b* formed in the front body 11 is sent to a hydraulic equipment such as a power steering device (not shown; denoted by reference symbol PS in FIG. 3) through a discharge port 28. The discharge port 28 is formed in a plug 28*a* provided to a side portion of the front body 11.

In the pump discharge paths (24, 23, 29, 42*a*, 43, 44, 45, and 28*b*) described above, the fluid path hole 29 that opens to the second fluid pressure chamber 37, and the side surface portion of the cam ring 17 form a variable metering orifice 40 that can increase or decrease the open area. The variable metering orifice 40 is formed when the fluid path hole 29 is opened or closed by the side wall portion in accordance with motion and displacement of the cam ring 17. If this orifice 40 is formed to have an appropriate shape whose opening/closing amount is controlled in accordance with the pump discharge fluid pressure, motion and displacement of the cam ring 17 can be controlled to a desired state, and variations in flow rate characteristics can be achieved.

The control valve 30 is arranged above the housing space 14 of the front body 11 to substantially perpendicularly intersect it. The control valve 30 controls the fluid pressure to move and displace the cam ring 17 (described above) in the body 11 (adapter ring 19) with respect to the rotor 15 by means of the variable metering orifice 40 (to be described later). The control valve 30 has a spool 32 which slides in accordance with the pressure difference between the upstream and downstream sides of the variable metering orifice 40 formed midway along the pump discharge path (24, 23, 29, 42*a*, 43, 44, 45, and 28*b*) in the valve hole 30*a* formed in the front body 11, and a biasing force of a spring 31.

In this control valve 30, a fluid pressure of the upstream side of the variable metering orifice 40 is guided to a one-side chamber 32*a* (left chamber in FIG. 3) of the spool 32 through fluid paths 46 and 47 extending from the pump discharge pressure chamber 23. A valve 33 serves to close the valve hole 30*a* having a rod 33*a* which locks leftward movement of the spool 32 in the valve hole 30*a* at such a position that the spool 32 does not close the open end of the fluid path 47.

The spring 31 is disposed in the other-side chamber 32*b* (right chamber in FIG. 3) of the spool 32. A fluid pressure on the downstream side of the variable metering orifice 40 described above is guided to the other-side chamber 32*b* from midway along a path extending to the discharge port 28, i.e., from the second fluid pressure chamber 37, through a fluid path 19*a* formed between the front body 11 and adapter ring 19 and a fluid path 34 formed in the body 11.

The pump suction path 25*a* communicating with the suction port 25 extends through substantially the central portion of the valve hole 30*a*, as described above. A suction fluid is supplied to the pump suction path 25*a* through an annular space formed by an annular groove 32*c* of the spool 32.

A fluid path 19*b* of the adapter ring 19 to be connected to a first fluid pressure chamber 36 (described later) formed between the adapter ring 19 and cam ring 17, and a fluid path 35 formed in the front body 11 open between the opening of the pump suction path 25*a* and the opening of the discharge fluid path 47. Normally, as shown in FIG. 3, the fluid path 19*b* and fluid path 35 communicate with the pump suction path 25*a* through a land 32*d* to guide the suction fluid pressure to the first fluid pressure chamber 36. When the spool 32 moves to the right for a predetermined amount or more, it is separated from the pump suction side, as is apparent from FIG. 6, and the pump discharge fluid pressure is supplied to the first fluid pressure chamber 36.

Figure 6:
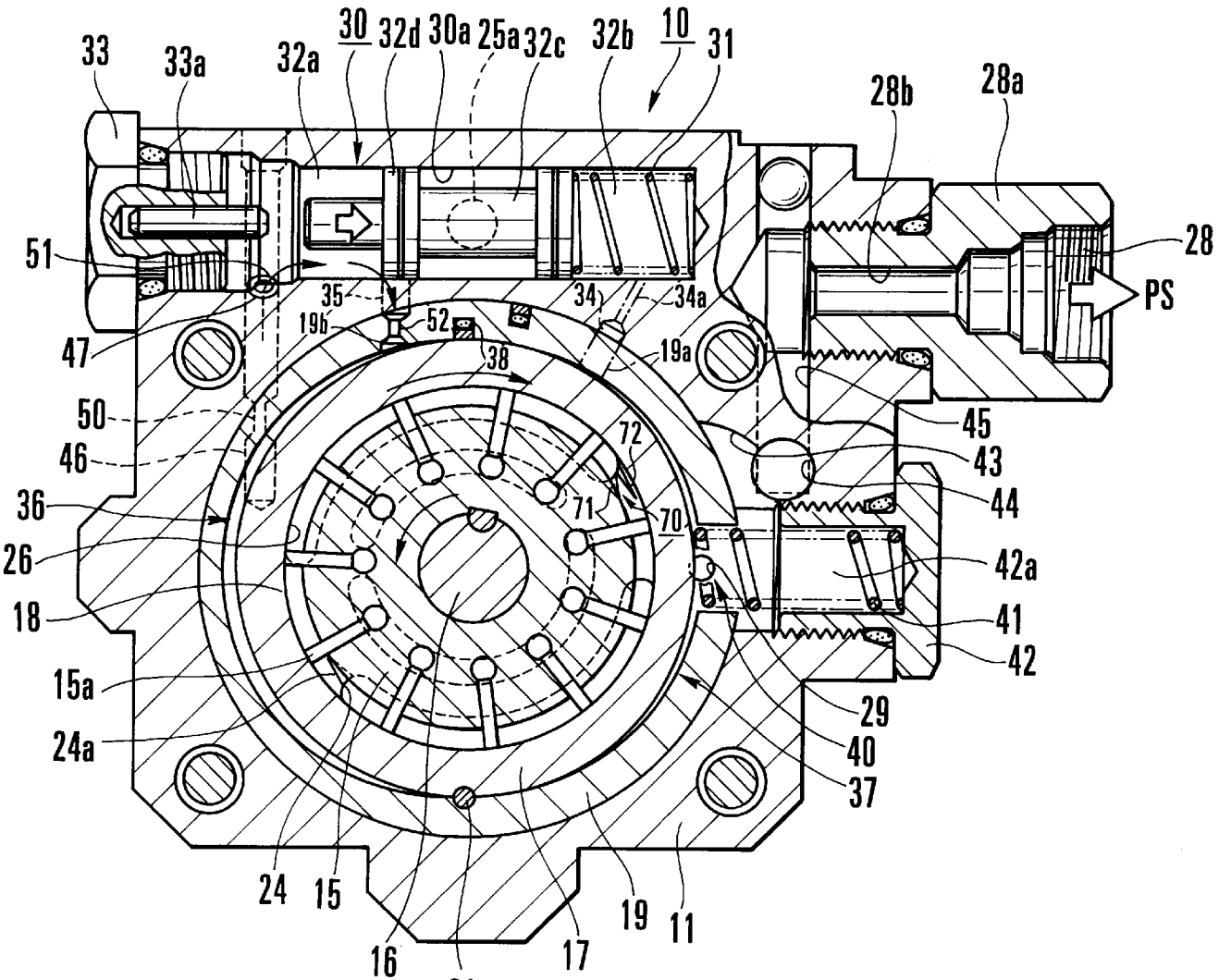
FIG. 6 is a schematic view for explaining a state wherein the variable displacement pump shown in FIG. 3 is actuated.

In FIG. 6, reference numeral 34*a* denotes a damper orifice portion.

First and second fluid pressure chambers 36 and 37 are formed between the outer cicumferential surface of the cam ring 17 described above and the inner circumferential surface of the front body 11 (adapter ring 19), to be divided on the left and right sides by the seal pin 21 and a seal member 38 formed at a position substantially axially symmetric to it. As the control valve 30 described above is actuated, the pump suction fluid pressure or the pump discharge fluid pressure on the upstream side of the variable metering orifice 40 is guided to the first fluid pressure chamber 36, and the pump discharge fluid pressure on the downstream side of the variable metering orifice 40 is guided to the second fluid pressure chamber 37.

A groove or the like may be formed in the outer circumferential surface of the cam ring 17 in the circumferential direction to extend for about substantially half the circumference, so that the first fluid pressure chamber 36 can be maintained even when the cam ring 17 comes into contact with the adapter ring 19.

Figure 5:
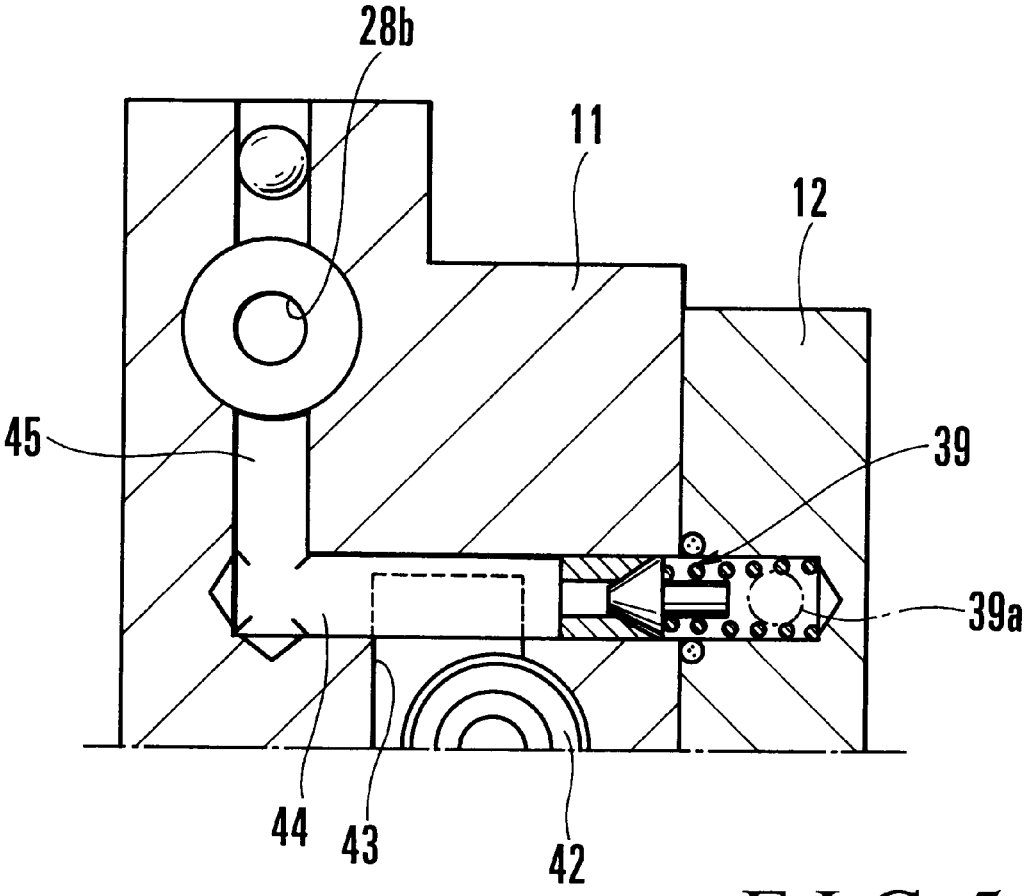
FIG. 5 is a sectional view taken along the line V—V of FIG. 3 to show the upper half.

In FIG. 5, a relief valve 39 is placed to oppose part of the pump discharge path. In this embodiment, the relief valve 39 is placed by utilizing part of the fluid path 44 formed in the body 11. A path hole 39*a* continuous to the relief valve 39 forms a path for returning the relieved fluid to the pump suction side.

When the fluid path hole 29 constituting the variable metering orifice 40 is closed by the cam ring 17, its open area changes. Hence, when the rotation speed is low, the pump is started to obtain a predetermined flow rate. When the rotation speed exceeds a constant value, the flow rate is decreased. When the rotation speed is equal to a predetermined value or more, a flow rate about half the initial flow rate can be obtained. This discharge amount control can be obtained by the variable metering orifice 40 formed by the fluid path hole 29 and the side surface portion of the cam ring 17 that controls the opening amount of the fluid path hole 29. The characteristics of discharge amount control can be changed by arbitrarily changing the shape of the hole 29 or adjusting the opening/closing control amount of the cam ring 17.

In the vane type variable displacement pump 10 described above, the arrangement of portions other than those described above is identical to that of a conventionally known pump, and a detailed description thereof will be omitted.

In the variable displacement pump 10 described above, in order to guide the fluid pressure of the pump discharge pressure chamber 23 to the control valve 30 and to the first fluid pressure chamber 36 through the control valve 30, thereby moving and displacing the cam ring 17, first, second, and third restrictors 50, 51, and 52 are formed on the fluid paths 46 and 47 between the pump discharge pressure chamber 23 and valve hole 30*a* and the fluid paths 35 and 19*b* between the valve hole 30*a* and first fluid pressure chamber 36.

More specifically, in the variable displacement pump 10, generally, the damper orifice portion 34*a* for stabilizing the motion of the spool 32 is formed between the fluid paths 19*a* and 34 that guide the fluid pressure on the downstream side of the variable metering orifice 40 to the other-side chamber 32*b* of the control valve 30. In the pump 10 of this type, since the passing flow rate of the fluid is small, the restrictor effect is small. The spool 32 oscillates, the fluid pressures of the first and second fluid pressure chambers 36 and 37 become unstable accordingly, and the cam ring 17 oscillates also. These phenomena cannot be suppressed.

For these reasons, in this embodiment, in order to suppress oscillation of the control valve 30 (spool 32) and cam ring 17, the restrictors 50, 51, and 52 are formed on the fluid paths 46, 47, and 35 (19*b*) on the pump discharge side. When the discharge fluid path is to be guided to the one-side chamber 32*a* and first fluid pressure chamber 36 in order to actuate the spool 32 of the control valve 30 and the cam ring 17, it is guided smoothly while obtaining a predetermined amount of flow appropriately, so that a damper effect can be exhibited.

Of the three restrictors 50, 51, and 52, at least either one or two, or all of the three may be formed.

For example, the first and second restrictors 50 and 51 can suppress oscillation of the spool 32 of the control valve 30 and oscillation of the cam ring 17 simultaneously. Although an effect can be obtained with either one of the first and second restrictors 50 and 51, if two of them are provided, a larger restricting effect can be obtained. The third restrictor 52 can suppress oscillation of only the cam ring 17, as is apparent from its position.

When three of the first, second, and third restrictors 50, 51, and 52 are provided, a maximum restricting effect can be expected.

When the first, second, and third restrictors 50, 51, and 52 are provided to suppress oscillation of the spool 32 and cam ring 17 in the variable displacement pump 10, pulsation of the pump discharge fluid pressure from the pump 10 can be decreased, and noise on the vehicle, generation of small vibration of the steering wheel, and oscillation generated when the relief valve 39 is actuated can be suppressed.

Figure 7A:
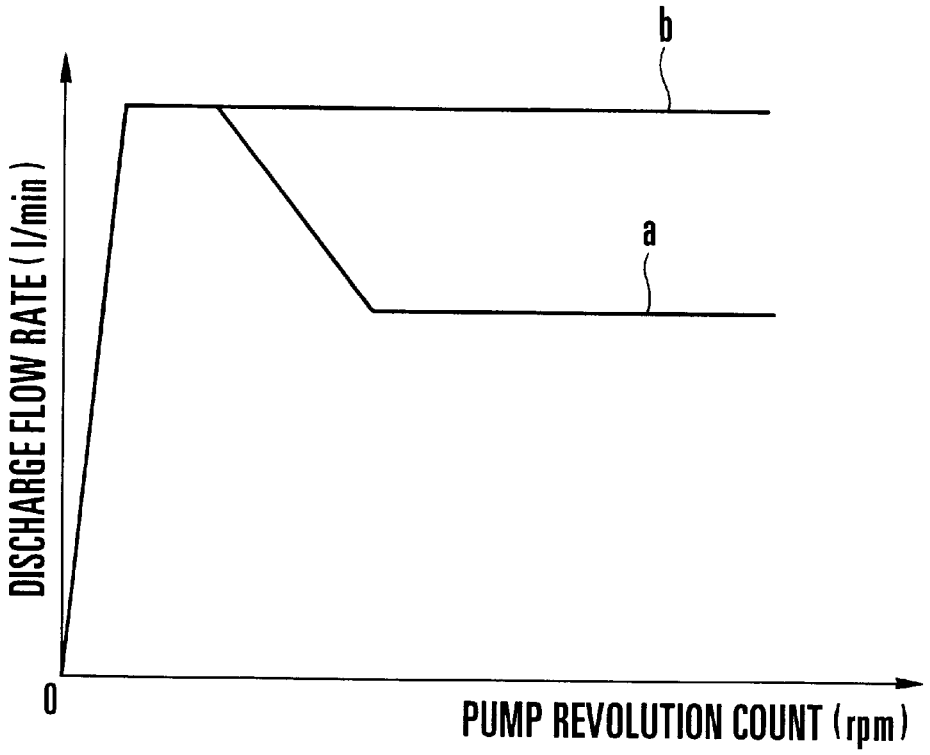
FIG. 7A is a graph showing the relationship between the pump revolution count and the discharge flow rate of the variable displacement pump according to the present invention.
Figure 7B:
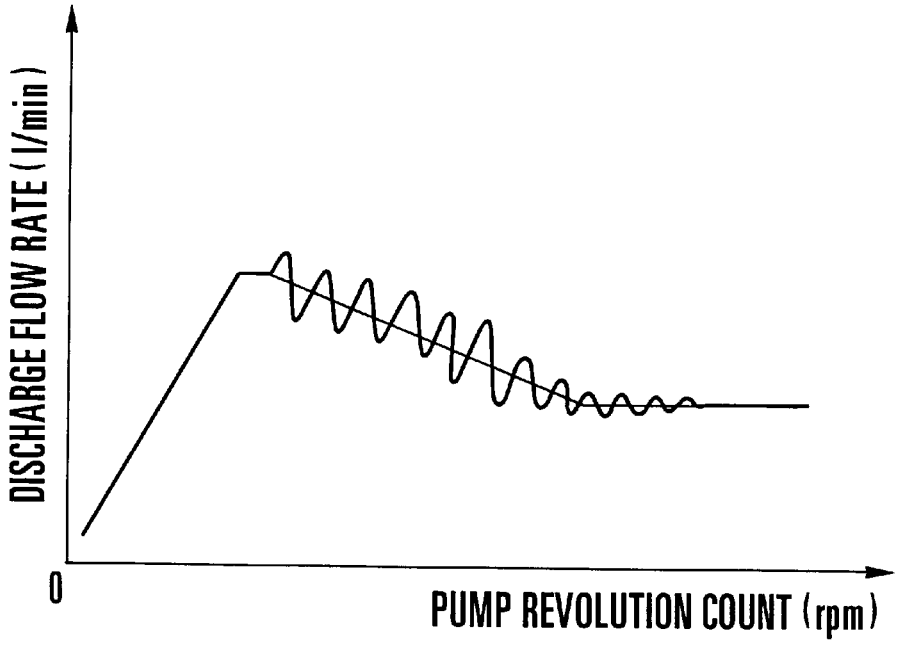
FIG. 7B is a graph showing the relationship between the pup revolution count and the discharge flow rate of the prior art.

More specifically, according to this arrangement, discharge flow rate characteristics with respect to the pump revolution count free from any problems such as pulsation can be obtained, as shown in FIG. 7A. In FIG. 7A, reference symbol a shows a case wherein, when the pump revolution count increases, the discharge flow rate is decreased to be smaller than the peak value, so that steering control during high-speed driving can be performed appropriately. This control can be performed easily by opening amount control with the variable metering orifice 40. A control operation as indicated by a curve b can also be freely performed, as a matter of course.

Of the restrictors 50, 51, and 52, if only the third restrictor 52 is provided, the fluctuation in pump discharge flow rate due to oscillation becomes about 1/15 that obtained when it is not provided. When only the first and third restrictors 50 and 52 are provided, the fluctuation becomes about 1/15 that obtained when they are not provided. When all of the first, second, and third restrictors 50, 51, and 52 are provided, the fluctuation becomes about 1/22 that obtained when they are not provided. This is confirmed from experiments.

In the pump 10 having the structure described in the above embodiment, a separate relief valve-type structure is employed, i.e., the relief valve 39 for preventing excessive increase of the pump discharge fluid pressure is arranged in the bodies 11 and 12 to oppose the pump discharge fluid path 44 separate from the control valve 30. However, a relief valve-incorporating structure in which a relief valve is incorporated in the spool 32 of the control valve 30 may be employed.

According to the present invention, in the variable displacement pump 10 having the above arrangement, as shown in FIGS. 1A and 1B, FIGS. 2A and 2B, and FIG. 3, at least one (the notch 70 of the pump suction opening 26) of the notches 70, formed by notching in the starting or terminal end portion (in this embodiment, starting end portion), in the rotor rotating direction, of the pump suction opening 26 and pump discharge path 24 which open to the pump chamber 18 to have a substantially V-letter shape, is constituted by a plurality of (two in this embodiment) notched grooves 71 aligned in the radial direction of the pump chamber 18 and having different lengths in the rotating direction of the rotor 15.

In FIG. 3, a notch 24*a* is formed on the starting end portion, in the rotor rotating direction, of the pump suction opening 26. The notch 24*a* is identical to that employed in the conventional pump. The notch 24*a* at this portion may be a notch formed by a plurality of notched grooves as described above.

With the notch 70 having this arrangement, the timing of communication in the rotating direction of the rotor 15 upon swing and displacement of the cam ring 17 differs depending on the pump revolution count. The notch 70 can be formed such that its sectional area gradually changes from its distal end to the proximal end on the pump suction opening 26 side in the rotating direction of the rotor 15.

Figure 2A:
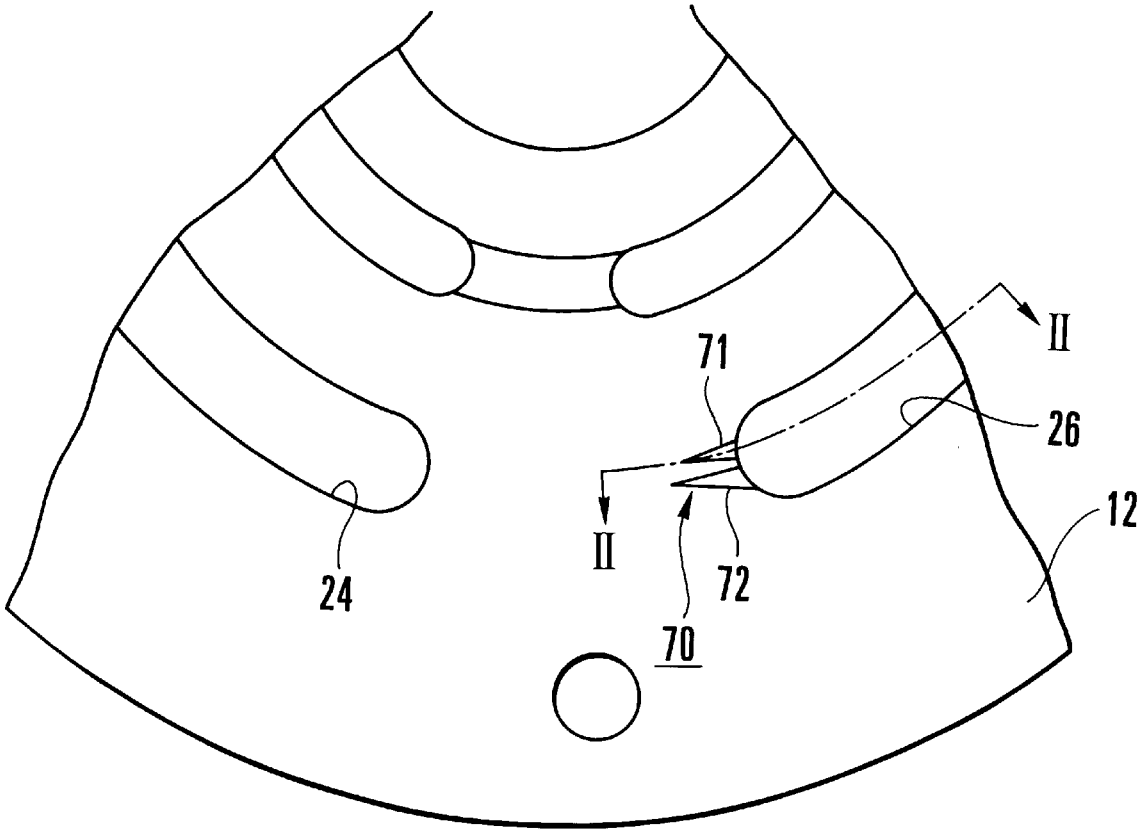
Figure 2B:
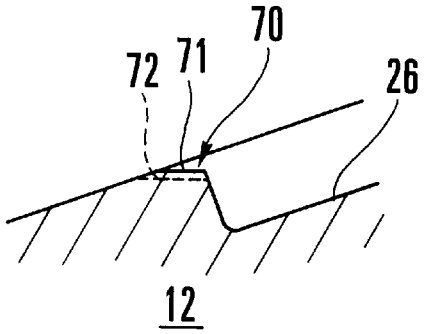

FIGS. 2A and 2B show the relationship between the notched grooves 71 and 72 of the notch 70 described above, and the pump suction opening 26.

Figure 1B:
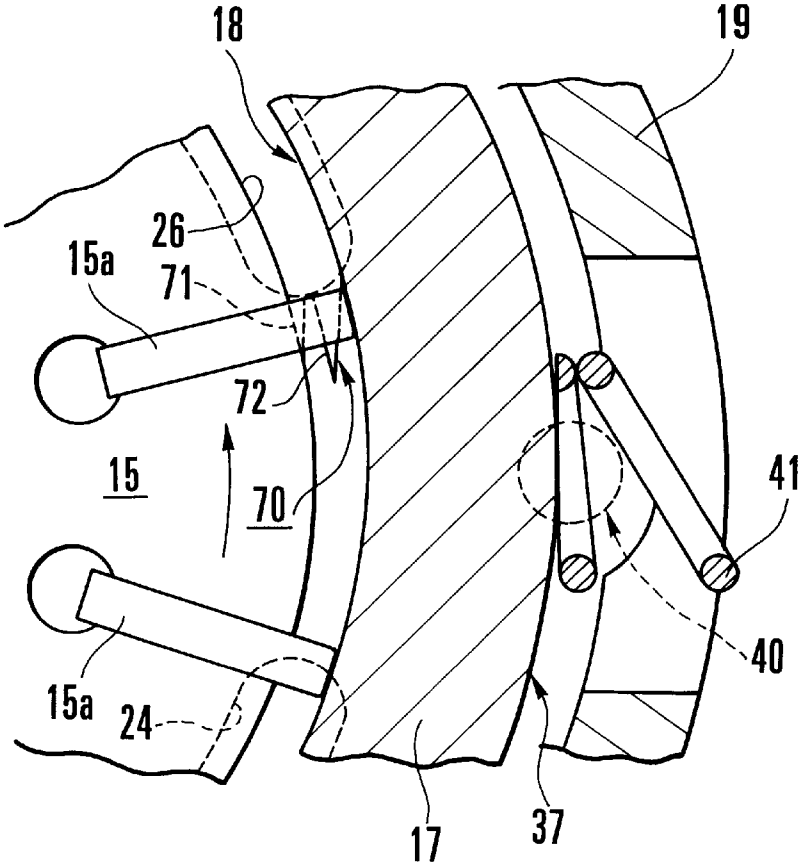
Figure 1A:
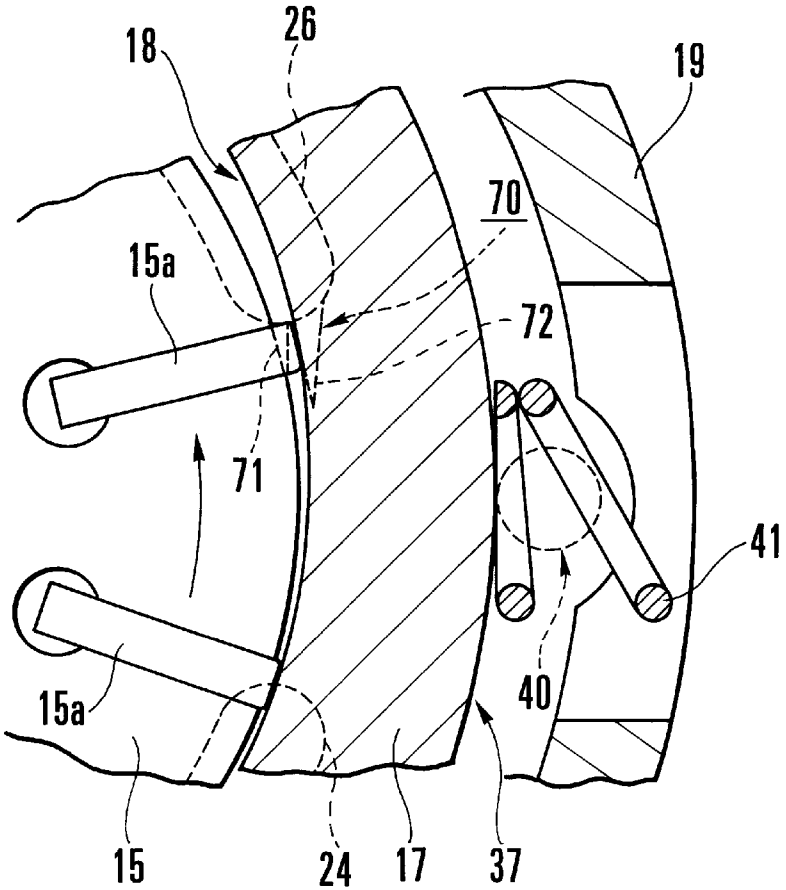

More specifically, as shown in FIG. 1A, while the pump 10 idles, only the inner notched groove 71 of the notch 70 opens to the pump chamber 18, and the outer notched groove 72 is closed by the cam ring 17. As shown in FIG. 1B, while the pump 10 rotates at high speed, the cam ring 17 is displaced to the right in FIG. 1B so that the outer notched groove 72 also opens to the pump chamber 18.

Therefore, when the open position of the distal end portion of the inner notched groove 71 described above in the rotor rotating direction is set at one for idling rotation of the pump 10 and the open position of the distal end portion of the outer notched groove 72 in the rotor rotating direction is set at one for high-speed rotation of the pump 10, the timing for communication in the rotor rotating direction can be appropriately set in accordance with the swing and displacement of the cam ring 17 accompanying the respective rotation speed.

When this notch 70 is employed, the end portions of the notched grooves 71 and 72 are located to be shifted in the radial direction of the pump chamber 18 and in the rotor rotating direction. While the variable displacement pump 10 is driven, even if the cam ring swings and is displaced in accordance with the pump revolution count, the notch 70 can communicate with the pressure chambers between the vanes at a timing matching the pump revolution count. The pressure change becomes moderate, and pulsation or noise on the pump discharge side can be decreased.

More specifically, when the notch 70 described above is formed in the pump suction opening 26, an optimum timing can be set since idling rotation until high-speed rotation of the engine, and oil pressure pulsation produced by a change in pump revolution count and noise produced by vibration of the pump can be decreased. As a result, a pump 10 having low noise in the entire rotation range can be obtained.

FIGS. 8A and 8B and FIGS. 9A and 9B show a variable displacement pump according to the second embodiment of the present invention. In FIGS. 8A and 8B and FIGS. 9A and 9B, portions identical or corresponding to those of FIGS. 1A and 1B and FIGS. 2A and 2B are denoted by the same reference numerals, and a detailed description thereof will be omitted.

In the first embodiment, the notch 70 is defined by the two notched grooves 71 and 72, as described above. In the second embodiment, a notch 70 has a large groove width, as shown in FIGS. 8A and 8B and FIGS. 9A and 9B, and is formed by one notched groove having a substantially trapezoidal distal end formed of a surface inclined in the rotor rotating direction. A pump suction opening 26 is formed in this notched groove in the pump revolving direction. Notched groove end portions 73 and 74 are formed on the two sides of the inclined surface of the notch 70. The notched groove end portions 73 and 74 are located at positions shifted from each other in different rotating directions between idling rotation and high-speed rotation.

Figure 8B:
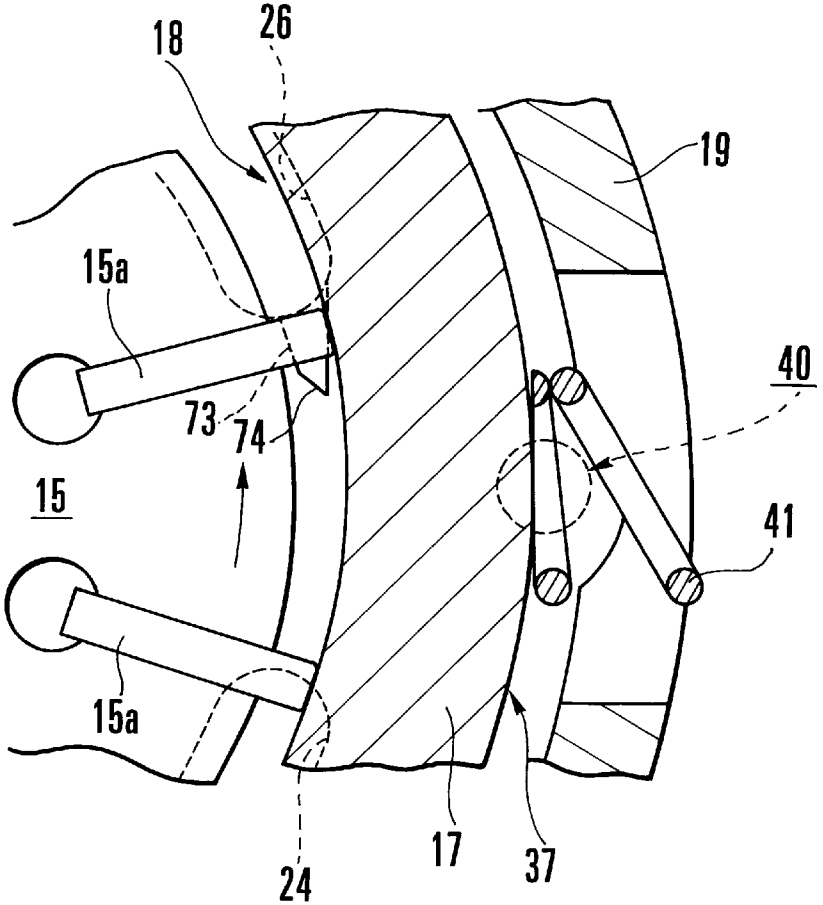
Figure 8A:
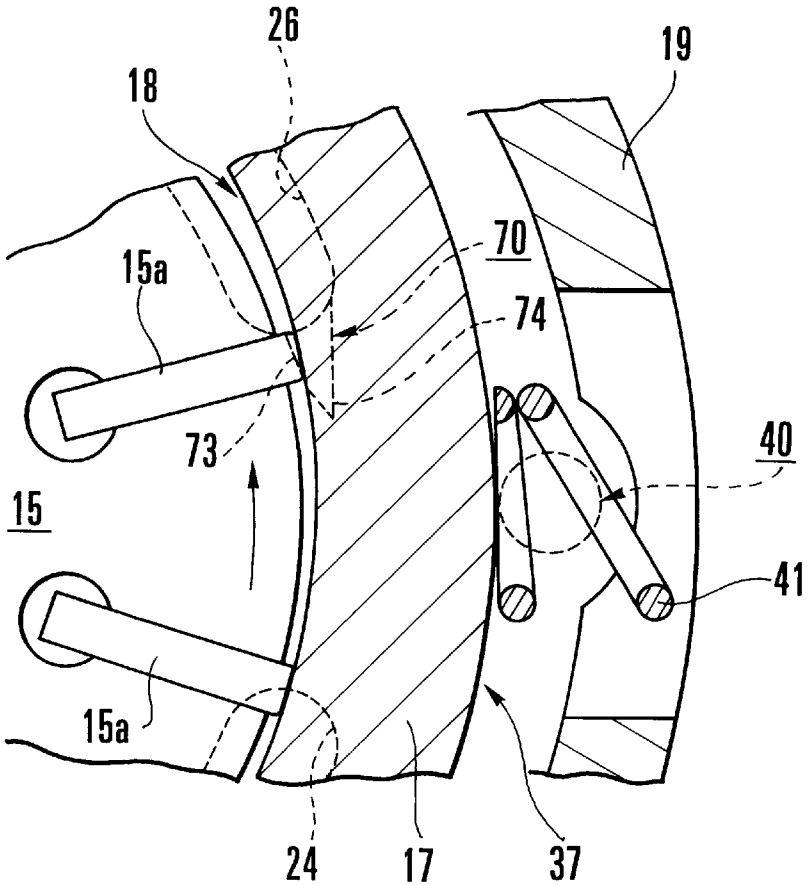
Figure 9A:
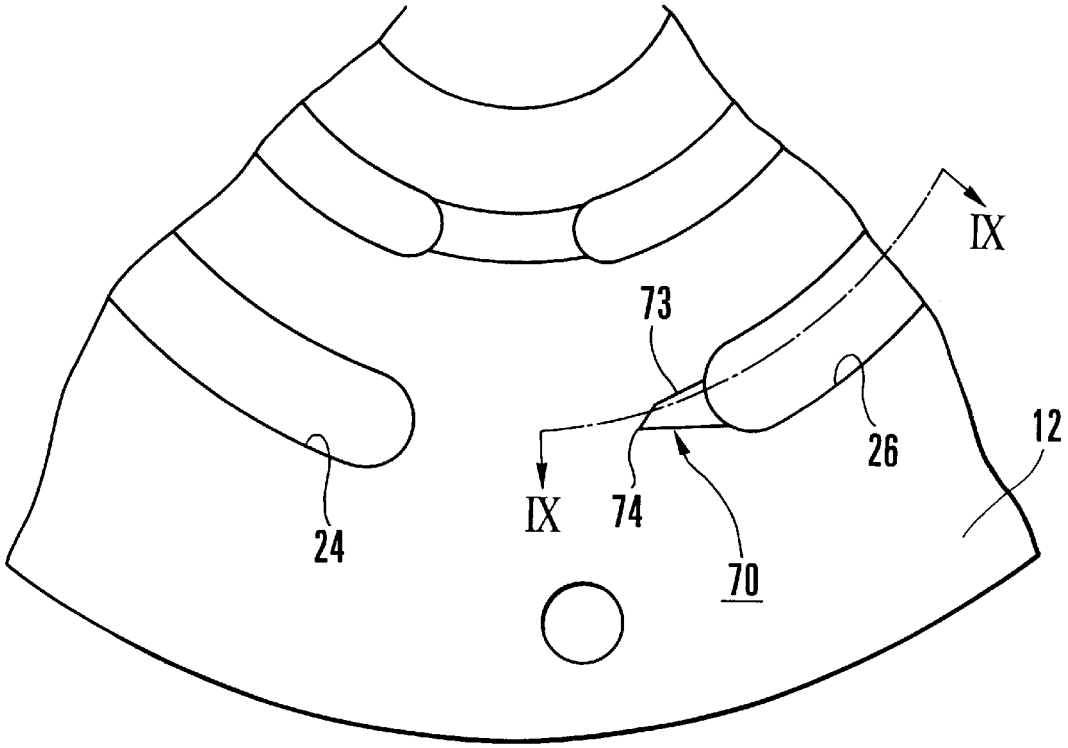
Figure 9B:
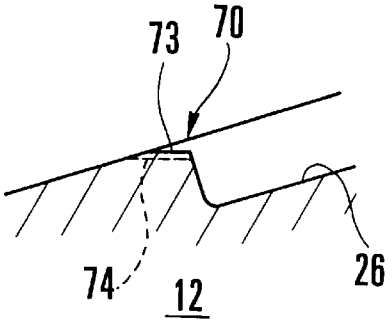

With the notch 70 having this structure, as shown in FIGS. 8A and 8B, the pressure chamber can communicate with the pump suction opening 26 at optimum timings different from each other between idling rotation and high-speed rotation of a pump 10. This pump 10 can change the open area formed by its groove more than the notch of the first embodiment described above can. As a result, sharp pressure fluctuation is decreased, and pulsation of the pump and noise can be further decreased.

With the notch 70 having this structure, the open area that changes in accordance with the amount of swing and displacement of a cam ring 17 can be changed more linearly than in the first embodiment described above.

Figure 10B:
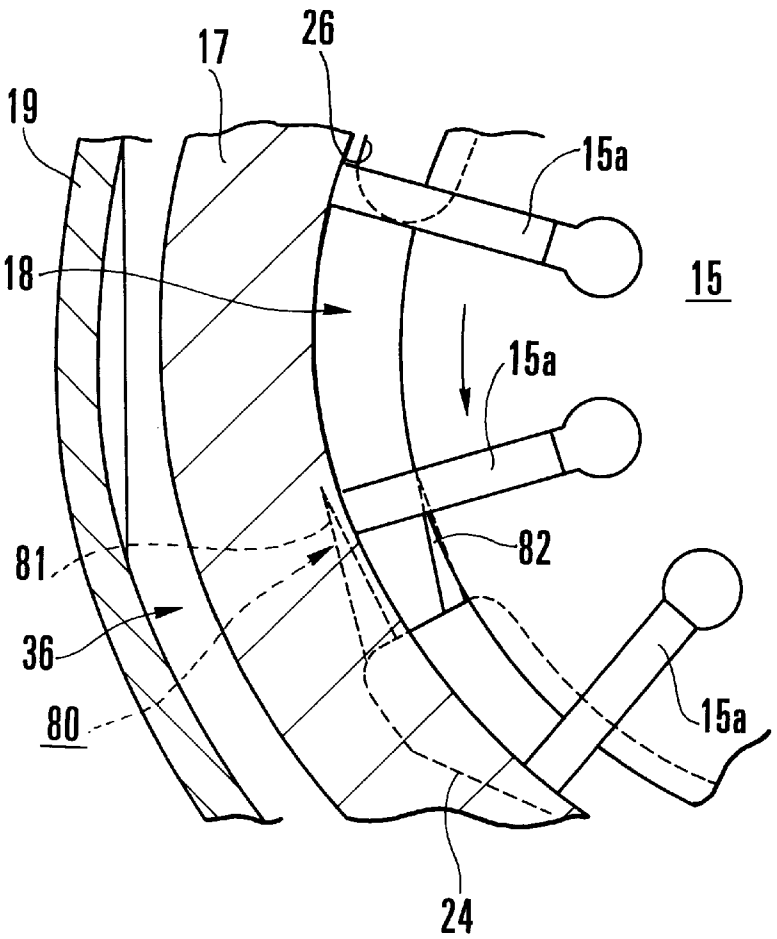
Figure 10A:
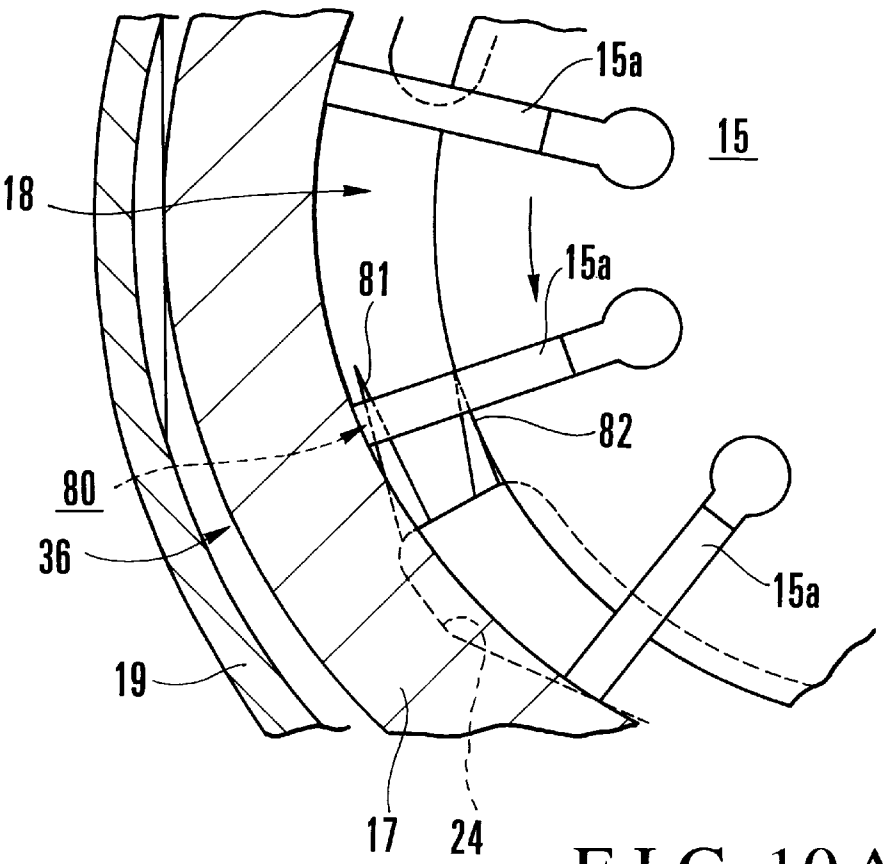

FIGS. 10A and 10B show a variable displacement pump according to the third embodiment of the present invention. In this embodiment, a notch 80 identical to that of the first and second embodiments described above is formed on the starting end portion, in the rotor rotating direction, of a pump discharge path 24. This notch 80 is formed by aligning a plurality of (two) notched grooves 81 and 82, having different lengths in the pump revolving direction, in the radial direction of a pump chamber 18.

In the third embodiment as well, apparently a function and effect almost equal to those of the first embodiment described above can be obtained.

In the third embodiment, if a notch 70 identical to that of the first or second embodiment described above is formed in a pump suction opening 26, a better effect can be achieved. The present invention is not limited to this, and a notch identical to that of the conventional pump may be formed in the pump suction opening 26.

Figure 11B:
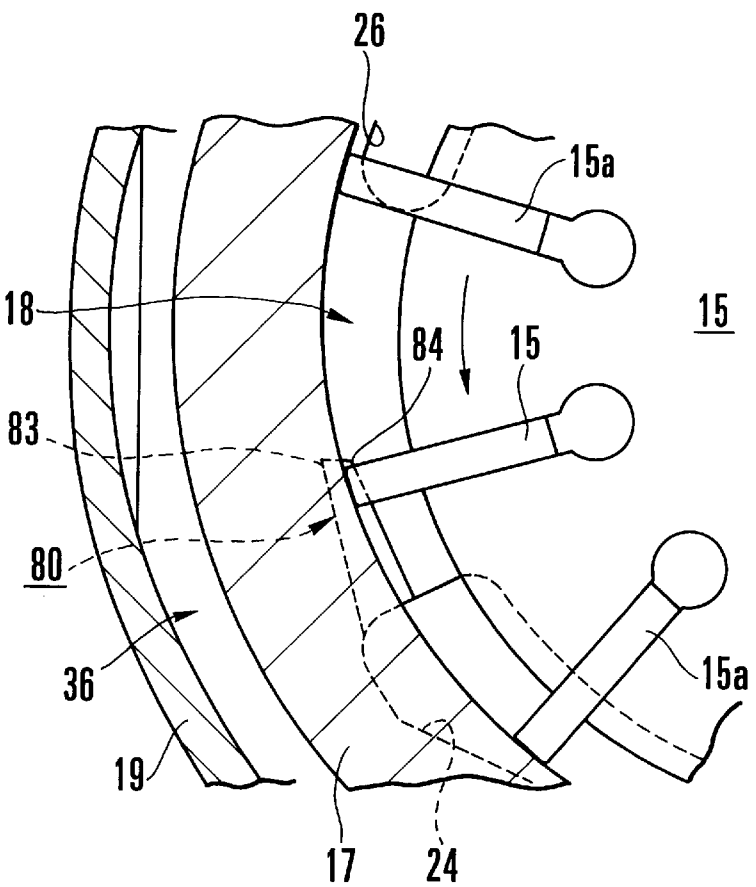
Figure 11A:
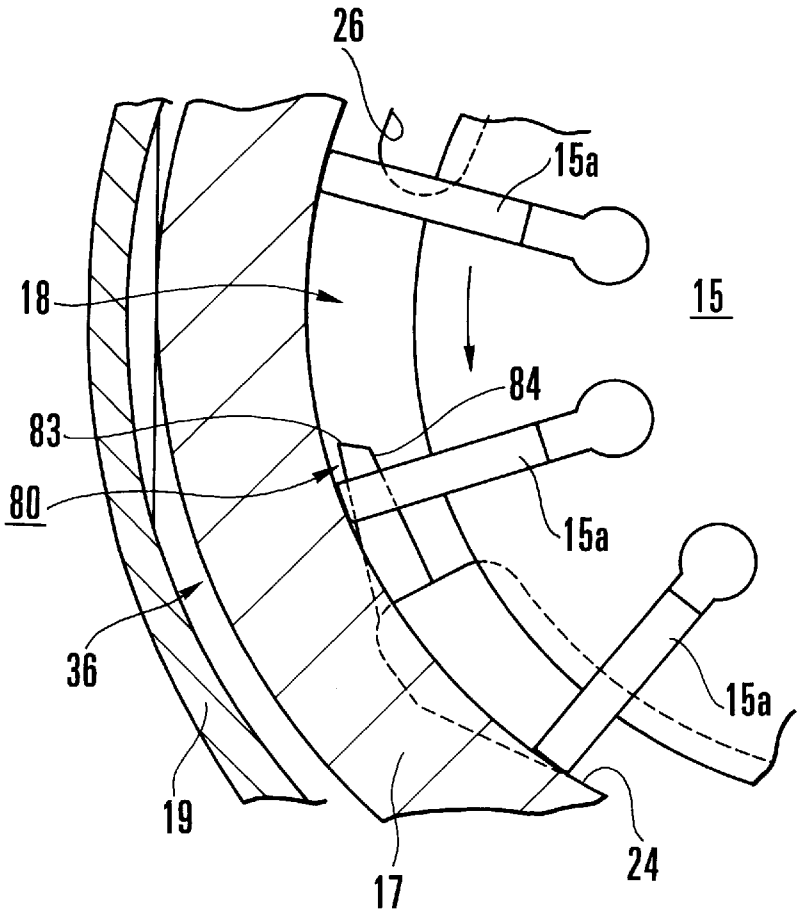
Figure 12:
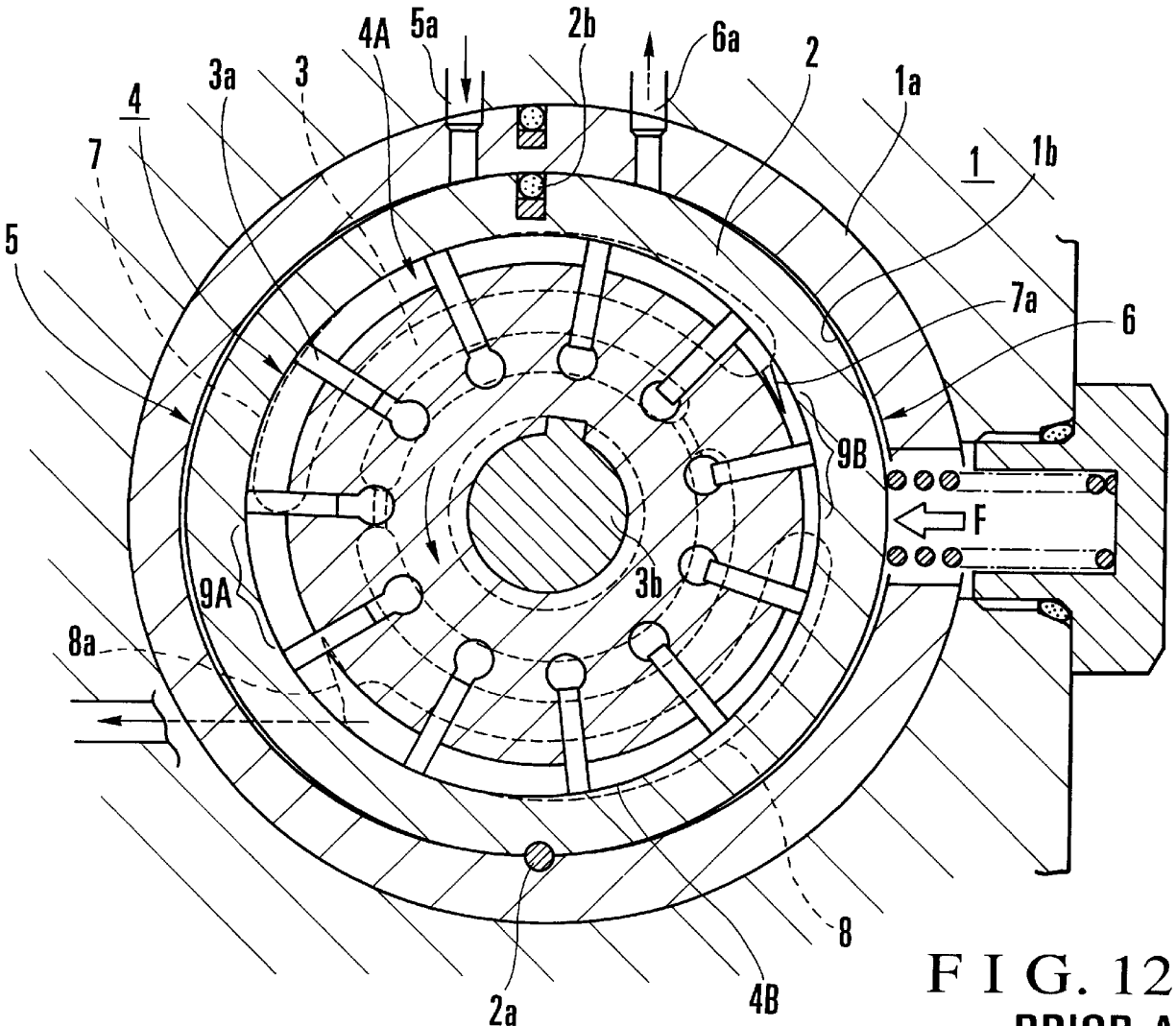
FIG. 12 PRIOR ART
FIG. 12 is a schematic view for explaining the structure of the main part of a conventional variable displacement pump.

FIGS. 11A and 11B show a variable displacement pump according to the fourth embodiment of the present invention. In the fourth embodiment, a notch 80 identical to that of the third embodiment described above is formed in the starting end portion, in the rotating direction of a rotor 15, of a pump discharge path 24. This notch 80 is formed with a plurality of (two) end portions 83 and 84, that are shifted from each other in at least the rotating direction and aligned in the radial direction of a pump chamber 18. The shape of the notch 80 of the fourth embodiment is somewhat different from that of the second embodiment described above. This is because the notch 80 is formed in that region of the pump chamber, which extends from the pump suction side to the pump discharge side.

In the fourth embodiment as well, a function and effect almost equal to those of the second embodiment described above can be obtained, as a matter of course.

In the fourth embodiment, if a notch 70 identical to that of the first or second embodiment described above is formed in a pump suction opening 26, a better effect can be achieved. The present invention is not limited to this, and a notch identical to that of the conventional pump may be formed in the pump suction opening 26.

The present invention is not limited to the structures of the embodiments described above. The shapes, structures, and the like of the respective portions may be freely, appropriately modified and changed, and various modifications are possible.

For example, in the embodiments described above, the notch 70 or 80 that characterizes the present invention is formed in the starting end portion, in the pump revolving direction, of each of the pump suction and discharge opening 26 and 24. However, the present invention is not limited to this, but the notch 70 or 80 may be formed in the terminal end portion, in the revolving direction, of each of the openings 26 and 24. The notch 70 or 80 may be formed at either end portion of any one of the openings 26 and 24 of the pump.

In the embodiments described above, the first and second restrictors 50 and 51 are formed in the fluid paths 46 and 47 extending from the pump discharge pressure chamber 23 to the one-side chamber 32*a* of the control valve 30. However, the present invention is not limited to this, and a plurality of restrictors, e.g., a total of four or more may be formed. For example, three or more restrictors may be formed on the fluid paths 46 and 47 described above, or two or more restrictors may be formed on the fluid paths 35 and 19*b* extending from the control valve 30 to the first fluid pressure chamber 36.

In the embodiments described above, the annular gap space for holding the cam ring 17 to be movable is formed by the adapter ring 19. However, the present invention is not limited to this, and the cam ring 17 may be held in the pump body 11 to be movable.

The vane type variable displacement pump 10 having the above arrangement is not limited to one having the structure described in the above embodiments. Other than the power steering device described in the above embodiments, the present invention can be obviously applied to various types of equipments and devices.

As has been described above, in the variable displacement pump according to the present invention, because of a notch, formed by notching in the terminal or starting end portion, in the rotor rotating direction, of the pump suction or discharge opening to have a substantially V-letter shape, and swing and displacement of the cam ring caused by a change in pump revolution count, the timing at which the pump suction or discharge opening communicates with the pressure chamber between the vanes, and a change in sectional area of the pump suction or discharge opening in the rotor rotating direction can be appropriately set. Despite the simple arrangement, the present invention has excellent effects as follows.

According to the present invention, the distal ends of a plurality of notched grooves forming a notch having a substantially V-letter shape, or a plurality of end portions of wide notched grooves are shifted from each other in the radial direction of the pump chamber and in the rotating direction of the rotor. While the variable displacement pump is driven, even if the cam ring swings and is displaced in accordance with the pump revolution count, the distal ends of the plurality of notched grooves or the plurality of end portions of the wide notched grooves communicate with the pressure chambers between the vanes at a predetermined timing in accordance with the pump revolution count. The pressure change becomes moderate, and pulsation or noise on the pump discharge side can be decreased.

With this arrangement, since pulsation decreases as described above, inconveniences such as generation of noise on the vehicle or small vibration of the steering wheel can be suppressed.

What is claimed is:

1. A variable displacement pump comprising:

a rotor having vanes and rotatable in a pump body;

a cam ring fitted on an outer circumferential surface of said rotor to form a pump chamber together with said rotor and arranged to be movable and displaceable in said pump body;

first and second fluid pressure chambers formed on two sides of an outer circumferential surface of said cam ring between said cam ring and said pump body to guide therein a fluid pressure corresponding to a flow rate of a pressure fluid discharged from said pump chamber, thereby moving and displacing said cam ring; and a pump suction opening and a pump discharge opening formed in side plate members, that form said pump chamber together with said rotor and said cam ring, to oppose pump suction and discharge sides, respectively, of said pump chamber, wherein notches are formed by notching in a starting or terminal end portion, in a rotor rotating direction, of said pump suction opening and said pump discharge opening to have a substantially V-letter shape, and at least one of said notches is formed to change a timing at which either one of said pump suction opening and said pump discharge opening communicates with a pressure chamber formed between said vanes in accordance with swing and displacement of said cam ring.

2. A pump according to claim 1, wherein said notches are aligned in a radial direction of said pump chamber, and are formed of a plurality of notched grooves having different lengths in the rotating direction of said rotor.

3. A pump according to claim 1, wherein said notches have a plurality of end portions located at positions different from each other in the rotating direction of said rotor, and are formed of wide notched grooves communicating in a radial direction of said pump chamber.

4. A pump according to claim 1, wherein said notch is formed in said starting end portion, in the rotor rotating direction, of said pump suction opening.

5. A pump according to claim 1, wherein said notch is formed in said starting end portion, in the rotor rotating direction, of said pump discharge opening.

6. A pump according to claim 1, wherein said notch is formed to gradually change a sectional area thereof from a distal end in the rotor rotating direction to a proximal end portion continuous to said pump suction opening.

7. A pump according to claim 1, wherein said notch is formed to gradually change a sectional area thereof from a distal end in the rotor rotating direction to a proximal end portion continuous to said pump discharge opening.

* * * * *